US006273600B1

(12) United States Patent
Sharpe

(10) Patent No.: US 6,273,600 B1
(45) Date of Patent: Aug. 14, 2001

(54) MICROBE SUSPENDER HAVING A VIBRATING BEATER FOR AGITATING THE CONTENTS OF A BAG

(75) Inventor: Anthony Nelson Sharpe, Almonte (CA)

(73) Assignee: Filtaflex Limited, Almonte (CA)

( * ) Notice: Subject to any disclaimer, the term of this patent is extended or adjusted under 35 U.S.C. 154(b) by 0 days.

(21) Appl. No.: 08/903,182

(22) Filed: Jul. 3, 1997

Related U.S. Application Data

(63) Continuation-in-part of application No. 08/645,594, filed on May 13, 1996, now abandoned.

(51) Int. Cl.[7] ..... B01F 11/00
(52) U.S. Cl. ..... 366/117; 366/197; 366/204
(58) Field of Search ..... 366/108, 110, 366/111, 117, 197, 198, 200, 201, 202, 204, 208, 212, 332–335, 349

(56) References Cited

U.S. PATENT DOCUMENTS 2,107,851 * 2/1938 Boehm .
2,235,942 * 3/1941 Moore .
2,419,330 * 4/1947 Anderson .
2,539,457 * 1/1951 Metheny et al. .
3,030,081 * 4/1962 Wilson et al. .
3,096,081 * 7/1963 Helm et al. .
3,503,592 * 3/1970 Taylor, Sr. et al. .
3,722,833 * 3/1973 Inoue et al. .
3,771,773 * 11/1973 Schriever .
3,819,158 * 6/1974 Sharpe et al. .
4,795,265 * 1/1989 Dahlberg et al. .
5,618,105 * 4/1997 Baker .
5,632,554 * 5/1997 Wang et al. ..... 366/208
5,779,974 * 7/1998 Kuzyk .
5,913,603 * 6/1999 Sperry et al. ..... 366/204
6,142,661 * 11/2000 LaFond ..... 366/204

* cited by examiner

*Primary Examiner*—Charles E. Cooley
(74) *Attorney, Agent, or Firm*—George A. Seaby

(57) ABSTRACT

A microbe suspender for determination of the microbiological quality of foods comprises a beater which beats the outside of a plastic bag containing test sample and suspending liquid at a frequency high enough that the bag does not completely follow the beater movement so that microbe suspending shock waves are transmitted into the liquid at each impact of the beater with the bag, yet low enough in frequency that on each impact the beater remains in contact with the bag long enough to transfer stirring energy to the liquid and test sample to aid the removal of deep-seated microbes. As additional improvements over the art the suspender provides a collecting tray which prevents hazardous microbial suspensions reaching the bench in the event that a bag leaks, and an operator-protecting door that does not comprise part of the beating/suspending mechanism so that it can be transparent and permit the action to be viewed, and additionally the door is completely removable to improve the cleanability.

9 Claims, 3 Drawing Sheets

MICROBE SUSPENDER HAVING A VIBRATING BEATER FOR AGITATING THE CONTENTS OF A BAG

This appln is a C-I-P of Ser. No. 08/645,594 filed May 13, 1996, Ser. No. 08/ 903,182.

FIELD OF THE INVENTION

The invention relates to devices for suspending microbes or other analytes to allow the determination of the microbiological safety or hygienic quality of foods and other samples or to mix powders or liquids.

BACKGROUND OF THE INVENTION

In order to determine the existence and quantity of microbes or other analytes in foods and clinical samples it is usual to remove them from the sample and disperse them in water or other liquid. It is common to suspend the microbes from a 10 gram sample into 90 ml of liquid, a total volume of 100 ml. The suspension preferably contains a minimum of debris suspended from the sample, since it may interfere with the analysis. It should be noted that microbes attached to surfaces are relatively easily removed, whereas those situated internally in pores or folds or otherwise trapped in foods require a greater effort to disperse them. Many techniques and devices have been developed with the aim of obtaining representative removals of the microbes from test samples, for example, swabbing the surface or pressing agar contact plates on them. However, the variability of microbial adhesion makes swabs and contact plates very imprecise in their yield of microbes.

Techniques in which a portion of the test sample is excised and blended in liquid in a blender or other device which breaks up the sample and disperses the microbes generally produce microbial suspensions that reflects more accurately the microbial load of the sample. However, a blender is inconvenient because the suspensions it produces contain a great deal of debris, and because it must be cleaned and sterilized after use. An apparatus in which the test sample is sealed in a plastic bag and kneaded and crushed by electric-motor driven paddles to produce representative microbial suspensions is described in U.S. Pat. No. 3819158. The microbe-suspending action of this apparatus depends on the crushing action and on the motion of the liquid as it is driven from side to side in the bag. This apparatus is convenient because the sample-containing bag may be discarded after use, thus eliminating the need to clean and sterilize the apparatus. However, the crushing action on samples still produces suspended debris and prevents the apparatus being used for samples containing hard objects such as stones or shell because these pierce bags and cause them to leak. Also, such crushing devices cannot safely use transparent glass or plastic doors and it is thus not possible to see the state of the sample without switching off the apparatus and opening it up.

In experiments on microbe removal from foods I have shown that a crushing action is rarely necessary and that high rates of liquid shear alone are very effective at suspending microbes. For example, the microbe suspending action of devices known as "vortex stirrers" is quite good but these devices are inconvenient because they cannot be used with large volumes or with disposable plastic bags. Similarly, spraying samples with liquid by means of a spray gun for which the impacting of the liquid spray causes a strong shear is effective; however, it is difficult to collect the microbe-containing liquid when the test surface is at certain angles to the vertical.

SUMMARY OF THE INVENTION

The vibration of liquids when sound waves are passed through them causes liquid shear at the surfaces of objects immersed in liquids, mainly because the differing densities of object and liquid prevent them from following the pressure waves at identical rates. Ultrasound, that is, sound at frequencies higher than human hearing abilities and generally in the range 20–30 kHz, has been shown to remove microbes efficiently from foods in limited situations, producing microbial suspensions relatively free of debris. However, ultrasound is useful only where microbes exist on surfaces that are easily accessible to the sound energy because sound intensities high enough to agitate samples and release internally situated microbes cause a cavitation which quickly kills microbes. At lower sound frequencies the energy for a given amplitude is less and less cavitation is produced; however, a device operating solely by sound energy in the audible range, such as might be generated by an electronic frequency generator and speaker or similar transducer would be impractically noisy in operation.

It should be noted that shock waves and sound waves are essentially similar and that shock waves can be generated in a liquid contained within a plastic bag by striking the bag sharply with a solid object. I have shown that a microbe suspender combining the microbe suspending ability of shock waves with a mechanical stirring effect that exposes the internal surfaces of samples without crushing them, removes microbes from foods effectively and reduces the amount of sample debris passing into suspension. Such an action can be obtained by beating a liquid-containing plastic bag alternately on its opposite faces by a beater at a frequency which is high enough to prevent the bag completely following the movements of the beater so that in each cycle of the beater it hits the bag and sends shock waves into it, provided that said frequency also is low enough that during a relatively large proportion of the beater cycle the beater remains in contact with the bag and transfers its energy efficiently to the bag as stirring energy. This energetic beating action is also very effective for mixing dry powders or for suspending them in liquids.

Referring again to U.S. Pat. No. 3819158, while this patent described the use of a plastic bag to which is applied mechanical energy in order to suspend microorganisms it describes a microbe suspending apparatus comprising two hard paddles kneadingly acting on the sample against a backing plate which forms part of the kneading means. Such a device must operate at approximately 300 pummellings per minute or slower. Carrying out this type of operation at higher speeds such as might cause shock waves is impossible because the paddles produce pressures in the liquid that rupture the bag. My invention provides a novel and improved means of suspending microorganisms in a plastic bag by providing for the combined application of shock waves and intense mechanical agitation to a sample and liquid contained in the bag.

By avoiding the crushing action of earlier apparatuses which knead samples inside plastic bags, my invention provides two major improvements. Firstly it minimizes the amount of sample debris passing into suspension, and secondly it permits the use of a transparent door through which the progress of the sample can be viewed, which is very desirable and which previously was not safely possible.

It has also been a problem with available bag-kneading microbe suspenders that the plastic bags are releasably sealed between an operator-protecting door and the kneading paddles by toggle clamping means that do not easily allow removal of the door to give the operator complete access to the kneading area. Thus it is difficult to clean up the mess when bag leakage occurs and in the event of a leak contaminated liquid drips onto the bench below the apparatus.

My invention provides means for confining a test sample with suspending liquid in a plastic bag, and of transmitting suspending energy to said sample and suspending liquid by means of non-crushing impacts on the outside of the bag, said impacts being within a range of frequency and amplitude such that they produce a suspending energy composed of a combination of shock or sound waves and mechanical shaking. To achieve this the sample and suspending liquid is releasably sealed in a flexible bag so that the bag hangs freely with some air space above the liquid. Said bag is then beaten by a vibrating or reciprocating beater which beats the bag on alternate sides at a frequency high enough that the bag is only able to partially to follow the movements of the beater thus producing an action in which:

1 the shock or sound waves caused by impact of the beater with the bag have a suspending effect, and;
2 impulses imparted to the liquid during the part of each cycle where the beater is in continuous contact with the bag produce a strong stirring action in the sample and suspending liquid which assists the suspending movement of liquid and by agitating the sample also improves the suspending effect, and;
3 no backing plate is required in order to produce the desired suspending action. Said beater is conveniently driven by an electric motor acting through a crank, but other sources of power are not excluded, for example, pneumatically reciprocating or electromagnetic actuators.

By operating in a frequency range where large amplitudes of mechanical movement are possible in the beating/suspending mechanism my invention avoids the need for the high frequency sound waves that would kill microbes if they were intense enough to remove microbes located on surfaces not accessible to the sound waves. Typically the beater is in the form of a horizontal oval and made of material not more than 6 mm diameter but other forms are not excluded, for example, beaters with vertical elements, flattened beating faces or even cups of sheet material completely surrounding the area of the plastic bag. As an additional improvement my invention provides an operator-protecting door which provides releasable sealing means for the bag without forming part of the suspending mechanism so that it can be made of a transparent material permitting the operator to see the state of the operation. Said door is also completely removable to allow complete access to the microbe suspending area for easy cleaning. My invention additionally provides a tray to contain liquid in the event that bag leaks occur, improving the cleanliness and safety of the laboratory. Thus my invention improves the art of microbe suspending though it may also be used advantageously to mix powders or distribute them in liquid.

BRIEF DESCRIPTION OF THE DRAWINGS

FIG. 1 shows a sectional view, FIG. 2 a sectional plan through plane II—II of FIG. 1, and FIGS. 3, 4, 5 and 6 show perspective views of acceptable beaters with the various forms of an oval ring of stiff rod, a ring with vertical beating elements, a ring with flattened beating faces, and as a cup, respectively.

DESCRIPTION OF THE PREFERRED EMBODIMENTS

Figure 1:
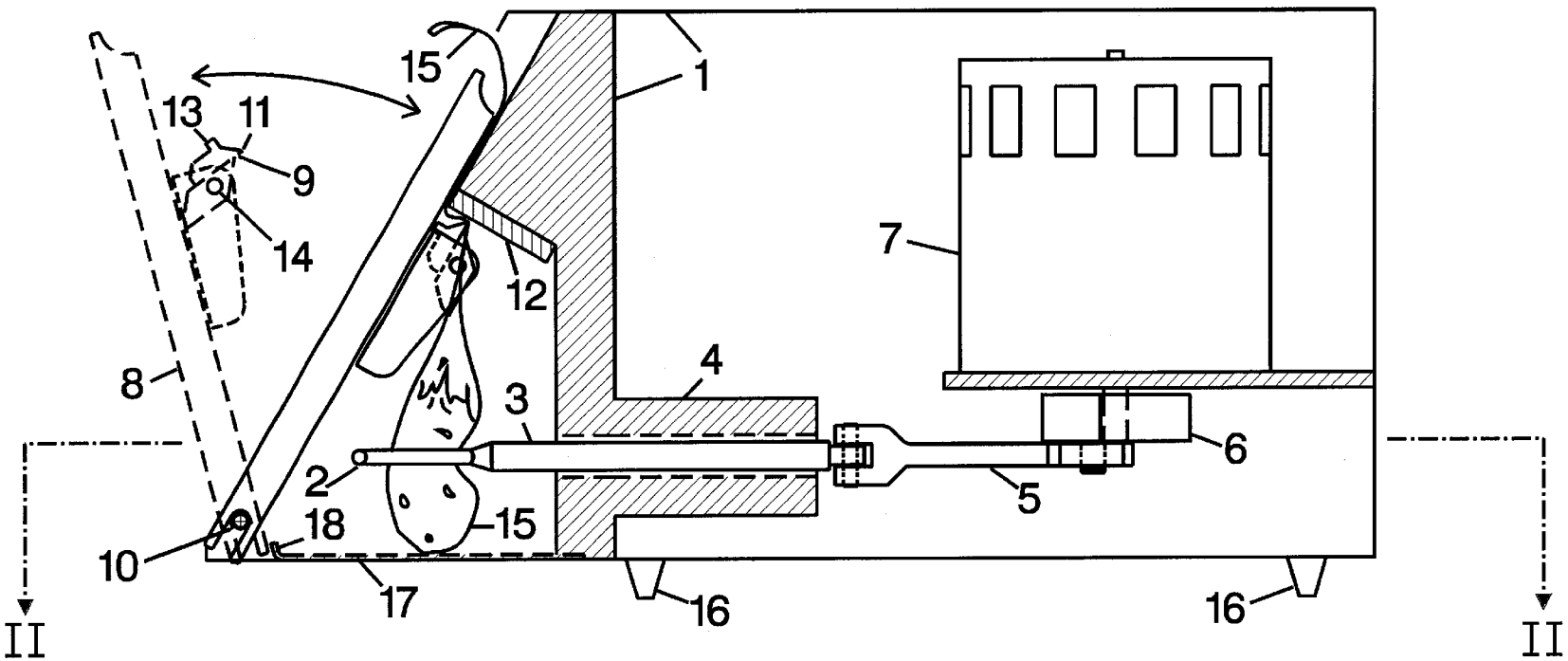
FIGS. 1 to 6 are schematic illustrations of one embodiment of the invention.
Figure 2:
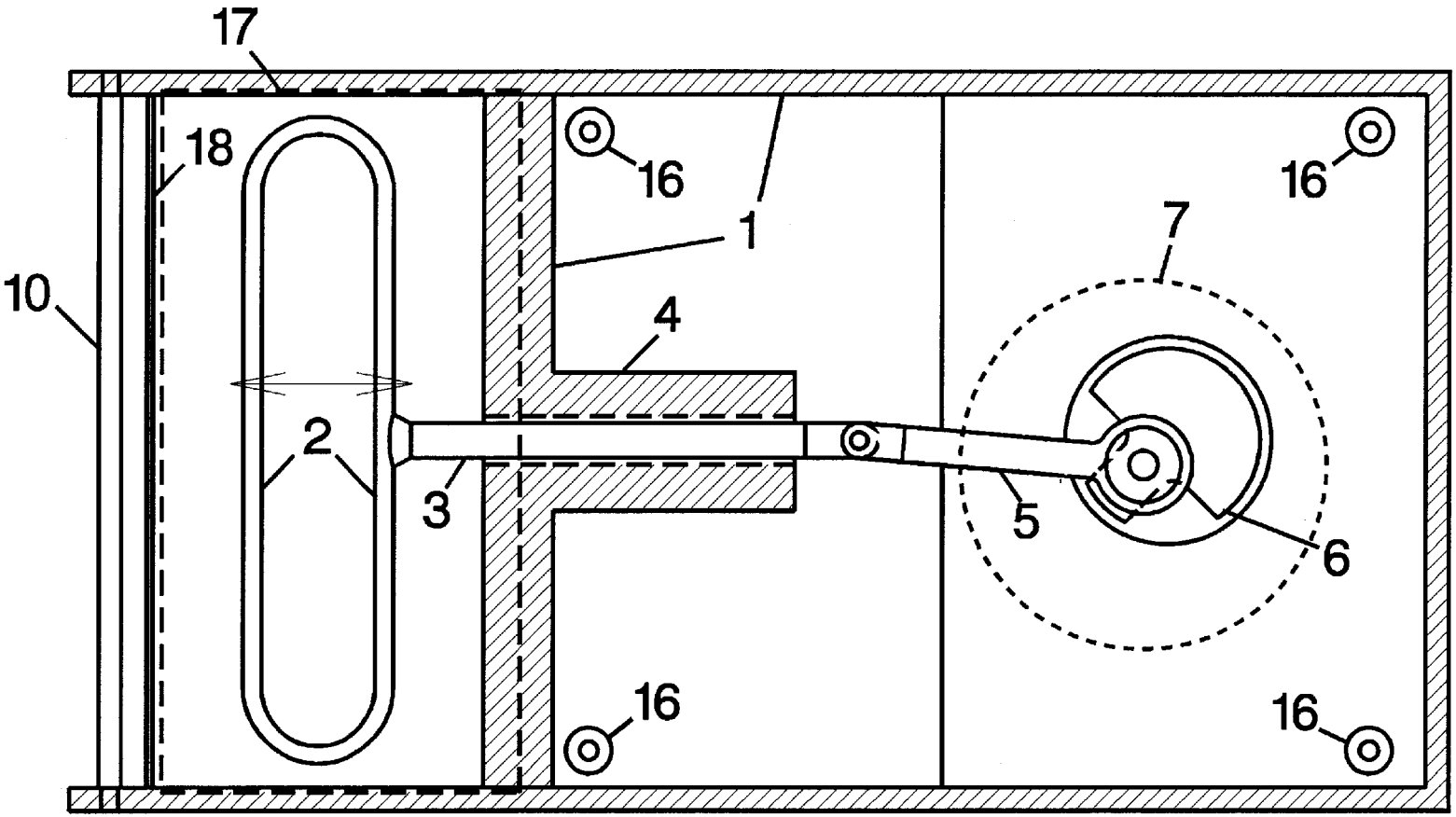

Referring to FIGS. 1 and 2, a rigid casing 1 carries all of the components of the invention. Beater means 2 of suitably stiff rod bent into a planar and horizontal oval is connected via shaft 3 through bushed plate 4 to connecting rod 5 and counter-balanced eccentric 6 to motor 7 so that when motor 7 is switched on the beater 2 reciprocates through an amplitude determined by eccentric 6 and with frequency determined by motor 7. A removable door 8 carries on it a pivotable toggle bar 9 arranged so that when door 8 is in the open position as shown in broken lines the toggle bar 9 is maintained by a spring not shown in the drawing, so that the distance between the door fulcrum rod 10 and the toggle clamping edge 11 is reduced by a suitable amount such that on closing door 8, shown in solid lines, toggle clamping edge 11 is initially able to slide under rubber strip 12. However, as soon as the toggle trip edge 13 contacts rubber strip 12 it causes the toggle to rotate on its pivot 14 thereby increasing the distance between toggle clamping edge 11 and door fulcrum rod 10 and forcing toggle clamping edge 11 firmly into rubber strip 12. By resting plastic bag 15 containing liquid-plus-sample against the outer edge of rubber strip 12 before door 8 is closed the bag becomes firmly clamped between toggle clamping edge 11 and rubber strip 12 until such time as the door is opened again.

The plastic bag 15 containing liquid-plus-sample is placed so that it lies inside the oval of beater means 2. The gap between the parallel sides of beater 2 is such that on switching on motor 7 beater means 2 vibrates against the bag, and because the bag cannot completely follow the movement of beater 2 the impacts of beater 2 alternating on both walls of the bag create microbe-suspending shock waves and stir the suspension. Rubber feet 16 reduce vibration of the bench when the apparatus is operating.

Any leakage of liquid from bag 15 during operation of the apparatus is prevented from dripping to the bench by tray 17 which is sealed to the lower edges of the suspending area. Lip 18 of tray 17 also serves as means to limit the angle of opening of door 8 during normal use. However, since door 8 is simply slotted where it fits on fulcrum rod 10 it may be completely lifted off if there is need to clean the apparatus. For plastic bags 100–150 mm wide and containing 100 ml of liquid-plus-sample satisfactory combinations of frequency and amplitude are 2,900 reciprocations per minute with an amplitude of 12–20 mm or 4,000–5,000 reciprocations per minute with an amplitude of 5–10 mm or values between thereof. At lower frequencies the bag and its contents follow the movement of the beater too closely and minimize the generation of shock waves; at frequencies much higher than 5,000 reciprocations per minute the bag does not follow the beater sufficiently and this minimizes the stirring effect. Suspending action is improved when there is a good air space above the liquid or powders being beaten and this is best obtained by sealing said bag between 50 and 125 mm above its bottom. If the seal is much higher than 125 mm the bag does not follow the movement of the beater sufficiently and if the seal is lower than 50 mm the shock waves easily become too intense and the bag bursts. For a plastic bag 100–150 mm wide and containing 100 ml of liquid the beater will be wider than the bag and will surround the bag, the spacing between those elements of the beater which contact the bag being not less than 20 mm and not more than 40 mm. During operation on test samples the intense liquid shearing action yields suspensions with a minimum of crushing action on the sample thus producing a suspension with a minimum of debris and providing less tendency for hard objects in the sample to cause bag leakages.

Figure 3:
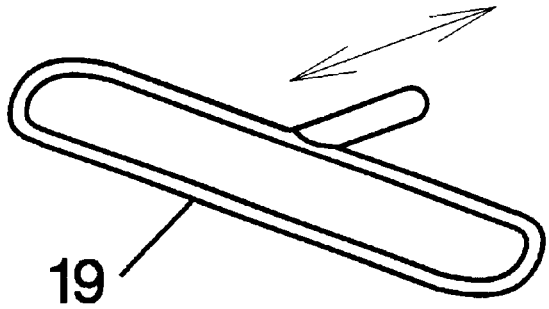
Figure 4:
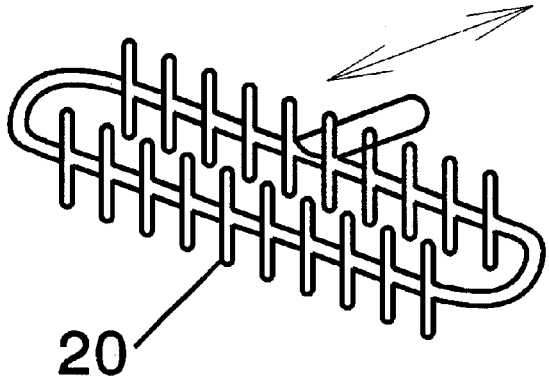
Figure 5:
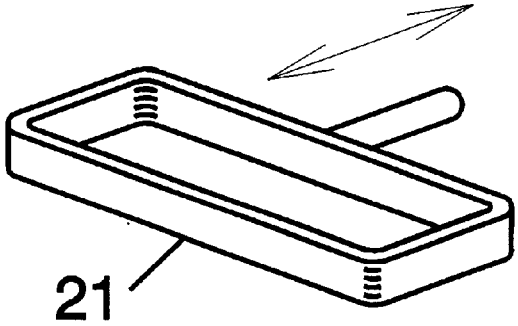
Figure 6:
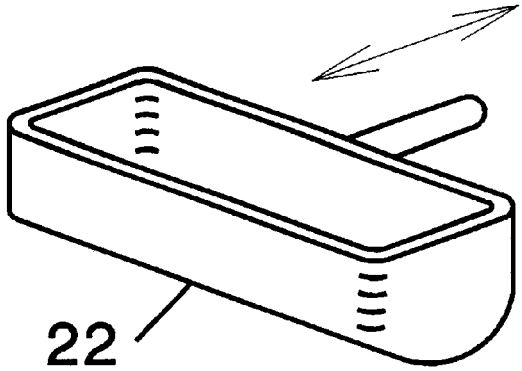

Referring to FIGS. 3, 4, 5, and 6, acceptable forms of beater means are shown. In FIG. 3 the previously described oval of stiff rod 2 is shown in its perspective view 19. Other acceptable forms also shown in perspective view are: in FIG. 4 a beater with vertical beating elements 20; in FIG. 5 a beater with flattened beating faces 21; and in FIG. 6 a cup 22.

I claim:

1. A microbe suspender comprising:

a casing;

an operator-protecting door mounted on the casing;

releasable sealing means for a bag containing sample and liquid disposed in the casing such that the door on closing releasably seals the bag;

a vibrating beater disposed in the casing for beatingly engaging the bag alternately on opposite faces, the vibrating beater vibrating in a frequency range between 2,900 and 5,000 cycles per minute with an amplitude between 5 and 20 mm, and;

drive means for the vibrating beater.

2. A microbe suspender as in claim 1 wherein the operator-protecting door does not form part of the beater.

3. A microbe suspender as in claim 1 wherein the beater is in the form of an oval ring surrounding the bag.

4. A microbe suspender as in claim 1 wherein the beater has flat beating faces.

5. A microbe suspender as in claim 1 wherein the beater has vertical beating elements.

6. A microbe suspender as in claim 1 wherein the beater is in the form of a cup.

7. A microbe suspender as in claim 1 wherein the drive means for the beater is an electric motor and crank.

8. A microbe suspender as in claim 1 wherein the operator-protecting door is completely removable.

9. A microbe suspender as in claim 1 wherein the casing additionally contains a liquid-retaining tray to retain liquid that may leak from a leaking bag.

* * * * *